US011647848B1

(12) United States Patent
Coates

(10) Patent No.: US 11,647,848 B1
(45) Date of Patent: May 16, 2023

(54) SWADDLE WITH MIGRATION PREVENTION

(71) Applicant: Tailored Technologies, Inc., Winston-Salem, NC (US)

(72) Inventor: Fredrica V. Coates, Winston-Salem, NC (US)

(73) Assignee: TAILORED TECHNOLOGIES, INC., Winston-Salem, NC (US)

( * ) Notice: Subject to any disclaimer, the term of this patent is extended or adjusted under 35 U.S.C. 154(b) by 0 days.

(21) Appl. No.: 17/667,815

(22) Filed: Feb. 9, 2022

(51) Int. Cl.
*A47D 15/00* (2006.01)
*A41B 13/06* (2006.01)

(52) U.S. Cl.
CPC ..... *A47D 15/005* (2013.01); *A41B 13/06* (2013.01)

(58) Field of Classification Search
CPC ..... A47D 15/00; A47D 15/005; A41B 13/00; A41B 13/06
See application file for complete search history.

(56) References Cited

U.S. PATENT DOCUMENTS

| | | | | |
|---|---|---|---|---|
| 1,723,644 | A * | 8/1929 | Collingbourne ..... | A41B 13/00 2/84 |
| 6,868,566 | B2 | 3/2005 | Gatten | |
| 8,191,188 | B2 | 6/2012 | Kaplan et al. | |
| 8,302,225 | B1 | 11/2012 | Earnest | |
| 8,347,432 | B2 | 1/2013 | Schmid et al. | |
| 8,667,631 | B2 | 3/2014 | Coates | |
| 8,782,831 | B2 | 7/2014 | Houston et al. | |
| 9,179,711 | B2 | 11/2015 | Krawchuk | |
| 11,147,319 | B2 | 10/2021 | Karp et al. | |
| 2004/0216230 | A1 | 11/2004 | Blackburn | |
| 2005/0150047 | A1 | 7/2005 | Trani et al. | |
| 2006/0010600 | A1 * | 1/2006 | Kendy ..... | A47D 15/005 5/482 |

* cited by examiner

*Primary Examiner* — Fredrick C Conley
(74) *Attorney, Agent, or Firm* — Suiter Swantz pc llo

(57) ABSTRACT

Disclosed is a swaddle including a main body defining continuously formed upper, lower, left side and right side portions having fasteners for maintaining the main body in a folded condition. Certain ones of the fasteners are positioned on the upper portion to maintain the lower portion, in a folded condition, over the upper portion and under the arms of the infant to prevent downward migration of the infant into the folded swaddle. Swaddle portions may include padding for comfort and define body and head portions for positioning the infant with respect to the upper portion.

8 Claims, 5 Drawing Sheets

SWADDLE WITH MIGRATION PREVENTION

BACKGROUND

Swaddling is the practice whereby an infant is wrapped in a blanket or similar cloth to tightly restrict movement of the limbs. Current studies suggest that swaddling helps an infant fall asleep and remain asleep while keeping the infant in a supine position, which lowers the risk of sudden infant death syndrome (SIDS).

Conventional swaddles rely on proper wrapping techniques to sufficiently bind the limbs and maintain gentle pressure across the chest and abdomen. A swaddle that is wrapped too tightly will hamper normal breathing and may put an infant at risk of overheating. A swaddle that is improperly wrapped will loosen over time as the infant becomes restless, allowing the limbs to be freed and portions of the swaddle to migrate over the face, putting the infant at risk of suffocation.

Accordingly, what is needed is a swaddle that obviates the need for skilled wrapping techniques, and which does not loosen over time, compromise breathing and allow the infant to migrate downward.

BRIEF SUMMARY

According to a first aspect, the present disclosure provides a swaddle including a main body defining an upper portion configured to receive an infant, a lower portion continuous with the upper portion and configured to be folded upward over the upper portion, a left side portion continuous with the upper and lower portions and configured to be folded inward over the lower portion in a folded condition, and a right side portion continuous with the upper and lower portions and configured to be folded inward over the lower portion in a folded condition. At least one fastener positioned on a back of the lower portion adjacent a longitudinal extent of the lower portion engages with spaced fasteners positioned on a front of the upper portion to maintain the lower portion in the folded condition. Fasteners positioned on the left and right side portions maintain the left and right side portions in their folded condition. A width of the lower portion, measured at the longitudinal extent of the lower portion, is greater than a distance between the spaced fasteners and less than a width of the upper portion, measured between the left and right side portions.

In some embodiments, the upper portion defines a body portion configured to position a body of an infant and a head portion configured to position a head of an infant, wherein the body and head portions are continuous and the spaced fasteners are positioned on the body portion.

In some embodiments, the body and head portions are padded.

In some embodiments, the main body is kite-shaped and the head portion extends from the upper portion away from the lower portion.

In some embodiments, the fasteners positioned on the left and right side portions include spaced first and second fasteners positioned on a front of the left side portion and spaced first and second fasteners positioned on a back of the right side portion.

In some embodiments, the fasteners positioned on the left and right side portions include spaced first and second fasteners positioned on a front of the right side portion and spaced first and second fasteners positioned on a back of the left side portion.

In some embodiments, the at least one fastener positioned on the back of the lower portion is an elongate loop fastener, and each of the spaced fasteners positioned on the front of the upper portion are hook fasteners.

In some embodiments, in use with an infant positioned on the upper portion, the lower portion folds upward over the upper portion to cover the torso, and the longitudinal extent of the lower portion secures around the torso and fastener to the spaced fasteners under the arms to prevent infant migration downward relative to the upper portion.

In some embodiments, each of the spaced fasteners comprises a hook fastener and a loop fastener continuous with the hook fastener, wherein the hook fastener is configured to engaged with the loop fastener to maintain the spaced fastener in a closed condition between uses of the fastener.

According to a second aspect, the present disclosure provides a method for swaddling an infant including in a first step providing a swaddle including a main body defining an upper portion, a lower portion continuous with the upper portion, a left side portion continuous with the upper and lower portions, and a right side portion continuous with the upper and lower portions, at least one fastener positioned on a back of the lower portion adjacent a longitudinal extent of the lower portion, spaced fasteners positioned on a front of the upper portion, and fasteners positioned on the left and right side portions, wherein a width of the lower portion, measured at the longitudinal extent of the lower portion, is greater than a distance between the spaced fasteners and less than a width of the upper portion, measured between the left and right side portion. In a second step, the infant is positioned on the upper portion such that the spaced fasteners are positioned under the arms of the infant. In a third step, the lower portion is folded upward. In a fourth step, the lower portion is secured in a folded condition by attaching the spaced fasteners of the upper portion to the at least one fastener of the lower portion, with the longitudinal extent of the lower portion positioned across the chest of the infant. In a fifth step, one of the left and right side portions (e.g., the right side portion) is folded inward over the folded lower portion. In a sixth step, the other of the left and right side portions (e.g., the left side portion) is folded inward over the folded one of the left and right side portions (e.g., the right side portion). In a final step, the fasteners of the left and right side portions are attached to maintain the left and right side portions in a folded condition.

BRIEF DESCRIPTION OF THE DRAWINGS

Implementations of the inventive concepts disclosed herein may be better understood when consideration is given to the following detailed description thereof, Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION

Figure 1:
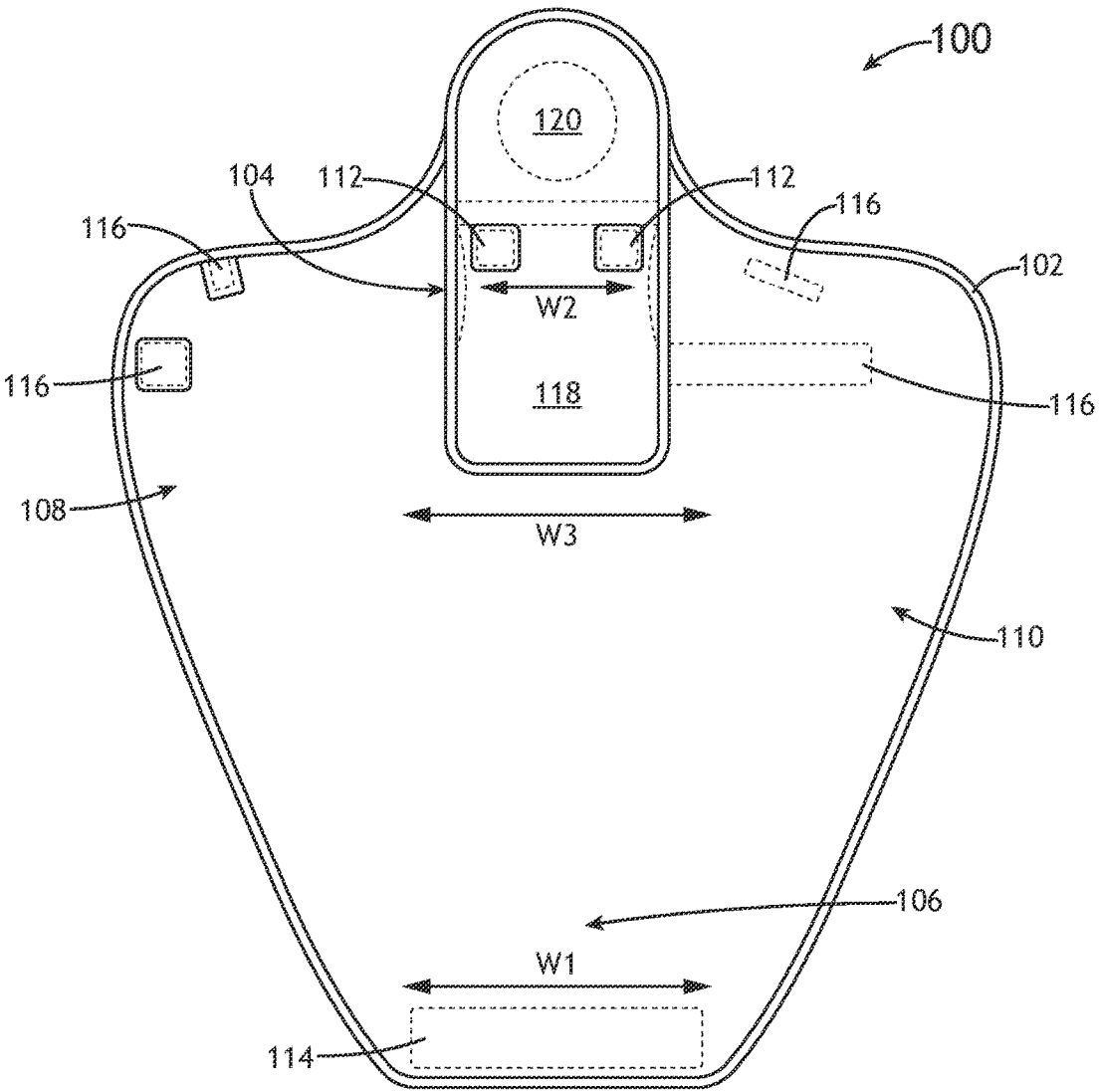
FIG. 1 is a front view of the swaddle illustrating an unfolded condition.

Before explaining aspects the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

Broadly speaking, embodiments of the inventive concepts disclosed herein are directed to swaddles generally including a main body portion and lower body portion, right side and left side portions, continuous with the main body portion, that fold and secure in place relative to each other and relative to the main body portion. Fasteners strategically positioned on portions of the swaddle interact with fastener counterparts to secure swaddle portions in place to maintain folded conditions. The lower portion, right side portion and left side portion secure in their respective folded condition away from the face. The swaddle facilitates a defined and intuitive folding procedure that obviates the need for skilled folding techniques, while maintaining a folded condition without downward migration into the swaddle.

Figure 2:
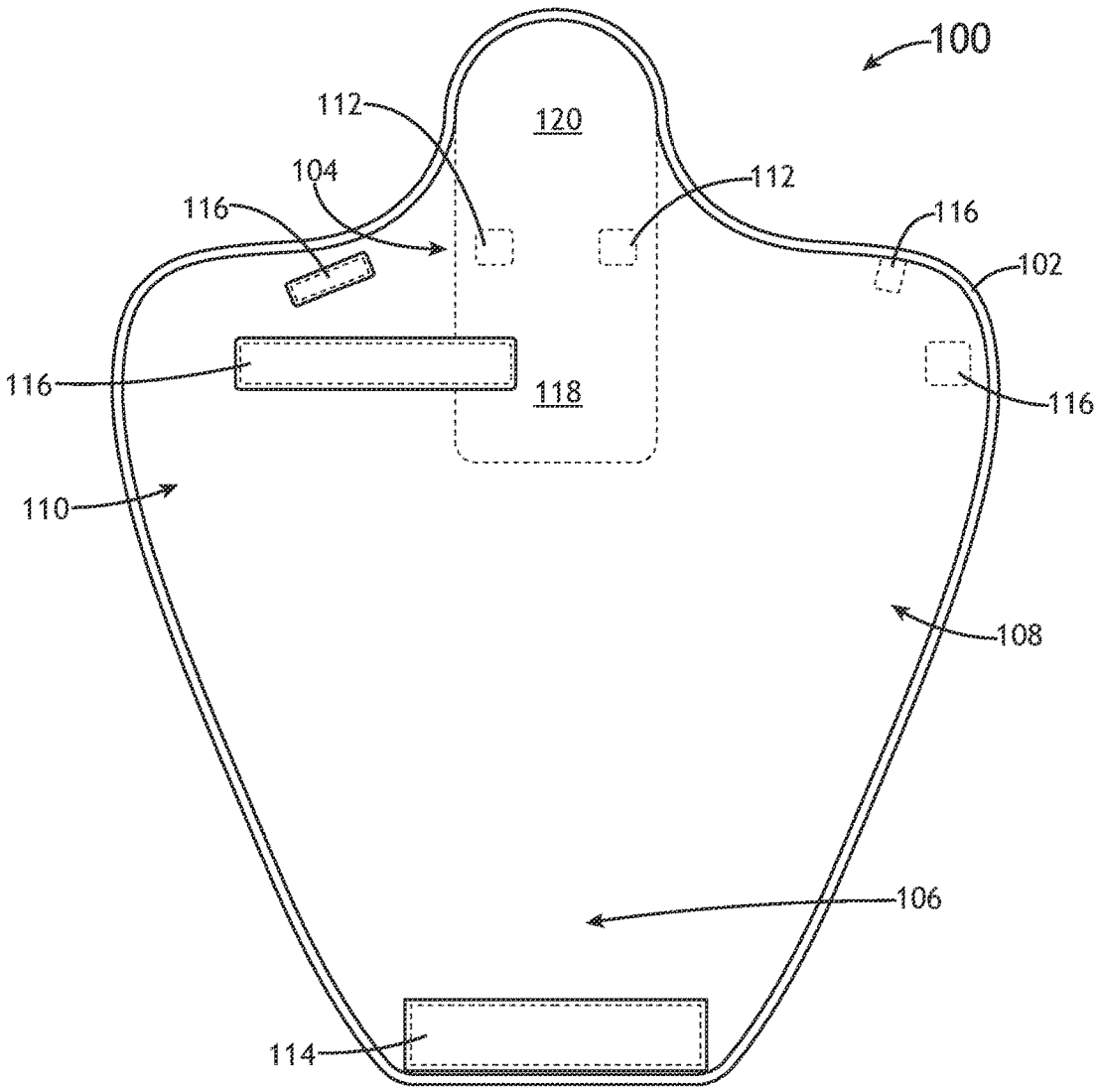
FIG. 2 is a back view of the swaddle illustrating the unfolded condition.
Figure 3:
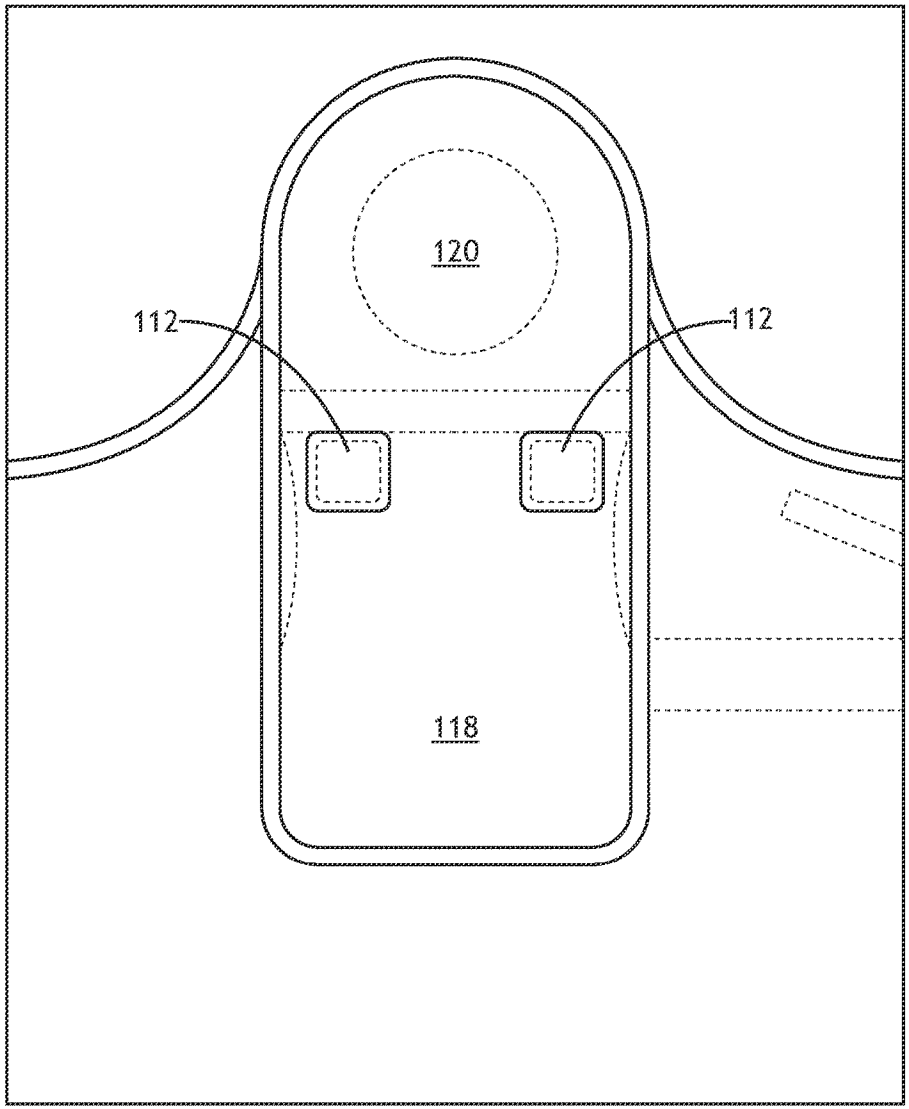
FIG. 3 is a detailed view of the upper portion of the swaddle.

FIGS. 1 and 2 illustrate a swaddle 100 according to a preferred embodiment of the present disclosure. The swaddle 100 generally includes a main body portion 102 for positioning an infant. The main body portion 102 defines an upper portion 104, a lower portion 106, a left side portion 108, and a left side portion 110, viewed from the 'front' or 'top". As used herein, the terms 'left' and 'right' with respect to the side portions denote the view of the swaddler and therefore may be used interchangeably with 'right' and 'left' from the opposite perspective, or 'first' and 'second' dissociated with any perspective. In some embodiments, the upper portion 104, the lower portion 106, the left side portion 108, and the right side portion 110 are continuously formed. In other embodiments, one of more of the aforementioned portions may be sewn together or otherwise joined. The swaddle 100 may include one or more layers.

The upper portion 104 has a length generally corresponding to a length of an infant from head to toe, for example a median infant length or oversized, and a width generally corresponding to a width of an infant, for example a median infant width or oversized. In some embodiments, the upper portion 104 includes internal padding positioned to enhance comfort by relieving pressure on the posterior of the infant. The upper portion 104 may include neck padding. The left side portion 108 is continuous with the upper and lower body portions 104, 106 along one lateral side thereof. The right side portion 110 is continuous with the upper and lower portions 104, 106 along an opposing lateral side thereof. In other words, the left and right side portions 108, 110 are positioned on opposite sides of the swaddle. As shown, the swaddle is generally kite-shaped and includes a protruding head portion.

Spaced fasteners 112 are positioned on opposite sides of the front of the upper portion 104, for example, positioned adjacent the lateral extents of the padded portion. The spaced fasteners 112 function to secure in place the lower portion 106 in a folded condition, as discussed further below. Each spaced fastener 112 may be a hook carrying counterpart of a hook-and-loop fastener system, or vice versa. Each spaced fastener 112 may include a hook carrying member having a fabric covered backing, edges and corners. Each spaced fastener 112 may be positioned adjacent or continuously formed with a loop carrying counterpart component such that the hook and look counterparts can be joined when laundering to prevent the hook counterpart from snagging on other articles or other loop counterpart fasteners.

At least one fastener 114 is positioned on the back of the lower portion 106. In some embodiments, the at least one fastener 114 is a single elongate loop fastener positioned at or adjacent the longitudinal extent of the lower portion 106. In other words, at the 'bottom' of the swaddle in the unfolded condition. As discussed further below, in use, the spaced fasteners 112 secure the lower portion 106 in a folded condition under the arms of the infant to prevent downward migration or sliding.

Left side and right side portion fasteners 116 are spaced along the curvature of one of the side portions and inward from the edge of the other one of the side portions. The fasteners on the opposing side portions are positioned on the front and back to engage when the side portions are folded inward to maintain the folded condition. For example, the fasteners positioned on the left and right side portions include spaced first and second fasteners positioned on the front of the left side portion and spaced first and second fasteners positioned on the back of the right side portion, or alternatively, the fasteners positioned on the left and right side portions include spaced first and second fasteners positioned on the front of the right side portion and spaced first and second fasteners positioned on the back of the left side portion. Like the spaced fasteners 112, each of the left and right side portion fasteners 116 may be a hook fastener, loop fastener, a hook carrying member having a fabric covered backing, edges and corners, a hook fastener positioned adjacent to or continuous with a loop fastener such that the hook and look counterparts can be joined when laundering, etc.

FIG. 2 details part of the upper portion 104. As shown, the upper portion 104 defines a body portion 118 for positioning the body of the infant with respect to the upper portion, and a protruding head portion 120 for positioning the head of the infant with respect to the upper portion. In some embodiments, the body and head portions 118, 120 are continuously formed and padded for comfort. Stitching provided in a circular pattern may further serve to center the head within the head portion 120.

Referring specifically to FIG. 1, the widths of the different portions of the swaddle is critical. In a preferred embodiment, the width of the longitudinal extent of the lower portion 106, shown as W1, is greater than the distance between the spaced upper portion fasteners 112, shown as W2, but less that the width of the upper portion, shown as W3. As such, the 'bottom' of the lower portion when folded upward is wide enough to cross the chest and be retained by the spaced fasteners 112 with some tucking under the infant but does not include extra material to be managed as with the case of a square swaddle. In other words, the kite shape including the taper toward the bottom, when viewed unfolded as shown in FIG. 1, provides the appropriate width relationships of the portions for securing around the infant without having to manage extra material. These dimensional relationships are critically important, along with the position of the spaced fasteners 112, for preventing downward migration into the swaddle.

Figure 4:
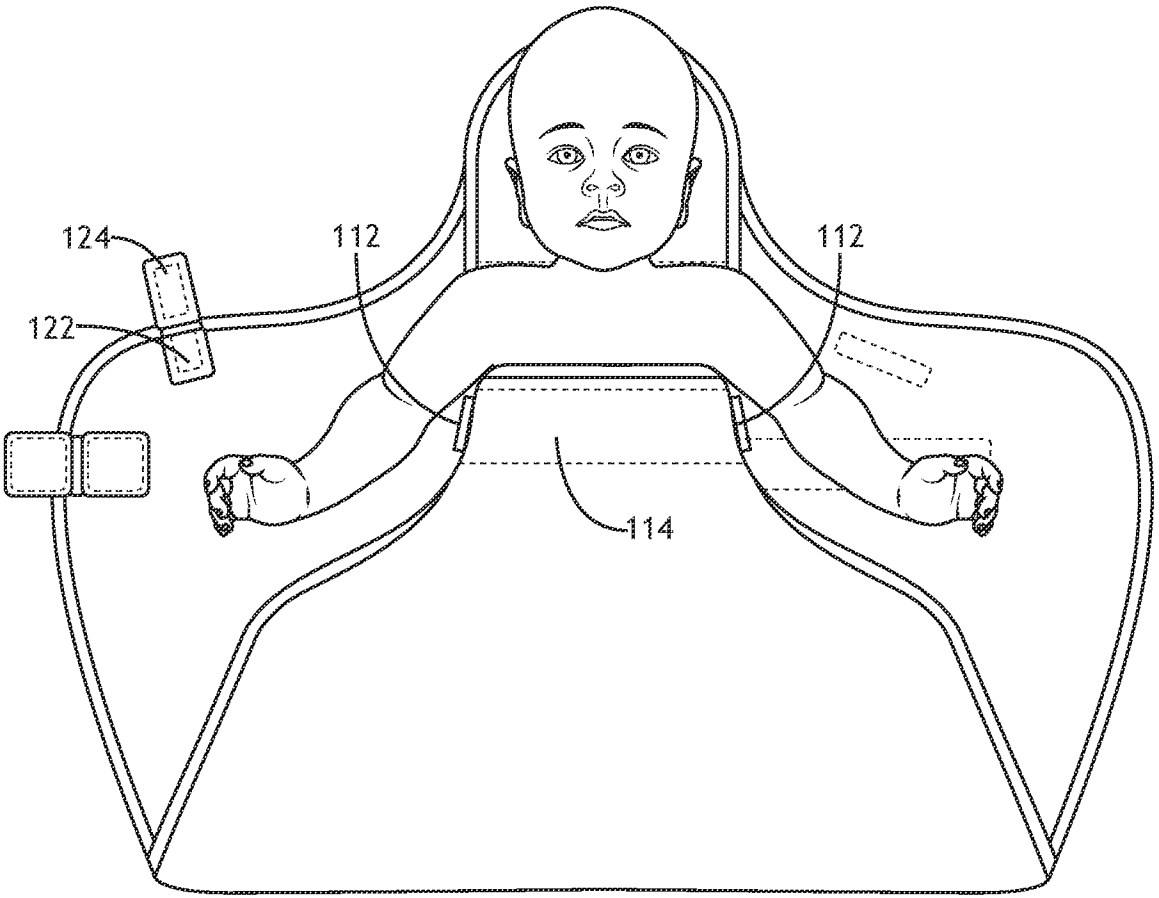
FIG. 4 illustrates an infant positioned on the swaddle and the lower portion in a folded and secured condition.
Figure 5:
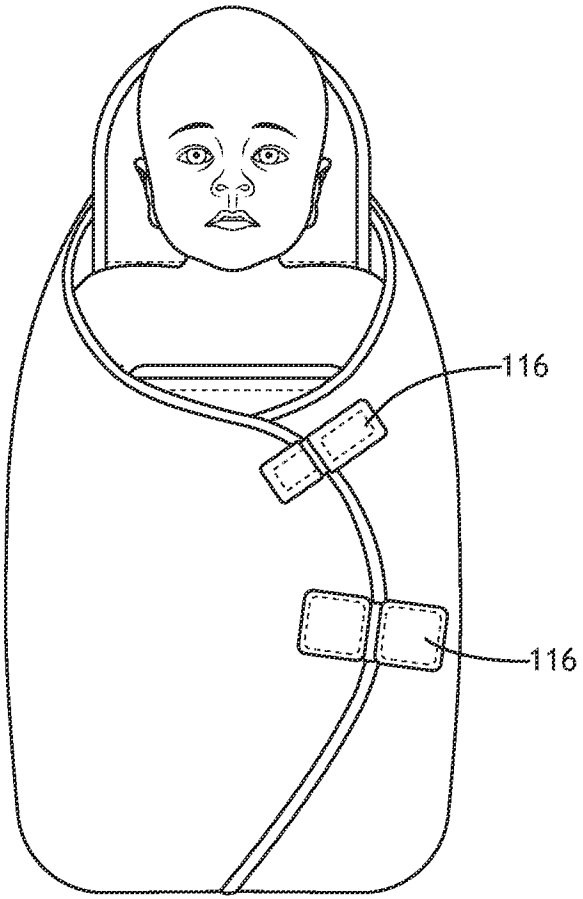
FIG. 5 illustrates the swaddle in a fully folded condition.

FIGS. 4 and 5 illustrate a preferred swaddling method according to the present disclosure. The first step of the method includes providing a swaddle according to the including a main body defining an upper portion, a lower portion continuous with the upper portion, a left side portion continuous with the upper and lower portions, and a right side portion continuous with the upper and lower portions, at least one fastener positioned on a back of the lower portion adjacent a longitudinal extent of the lower portion, spaced fasteners positioned on a front of the upper portion, and fasteners positioned on the left and right side portions, wherein a width of the lower portion, measured at the longitudinal extent of the lower portion, is greater than a distance between the spaced fasteners and less than a width of the upper portion, measured between the left and right side portion.

In a second step of the method, the infant is positioned on the upper portion such that the spaced fasteners are positioned under the arms of the infant. In a third step, the lower portion is folded upward to cover the body. In a fourth step, the lower portion is secured in a folded condition by attaching the spaced fasteners 112 of the upper portion to the at least one fastener 114 of the lower portion, with the longitudinal extent of the lower portion positioned across the chest of the infant. In a fifth step, one of the left and right side portions (e.g., the right side portion) is folded inward over the folded lower portion. In a sixth step, the other of the left and right side portions (e.g., the left side portion) is folded inward over the folded one of the left and right side portions (e.g., the right side portion). In a final step, the fasteners of the left and right side portions are attached to maintain the left and right side portions in a folded condition.

In the fully folded condition, the lower portion secures under the arms of the infant to prevent the swaddled infant from slipping 'downward' into the swaddle, which could compromise the ability to breathe among other harmful effects. With the torse secured, the arms can then placed against the sides and the flaps folded over the body to complete the swaddling. Alternatively, the arms can be left out of the swaddle according to some uses. Elongated fasteners provide adjustability in sizing.

While the foregoing description provides embodiments of the invention by way of example only, it is envisioned that other embodiments may perform similar functions and/or achieve similar results. Any equivalent embodiments and examples are within the scope of the present invention and are intended to be covered by the appended claims.

What is claimed is:

1. A method for swaddling an infant, comprising:

providing a swaddle comprising:

a main body defining an upper portion, a lower portion continuous with the upper portion, a left side portion continuous with the upper and lower portions, and a right side portion continuous with the upper and lower portions;

at least one fastener positioned on a back of the lower portion adjacent a longitudinal extent of the lower portion;

spaced fasteners positioned on a front of the upper portion; and fasteners positioned on the left and right side portions;

wherein a width of the lower portion, measured at the longitudinal extent of the lower portion, is greater than a distance between the spaced fasteners and less than a width of the upper portion, measured between the left and right side portion;

positioning the infant on the upper portion such that the spaced fasteners are positioned under the arms of the infant;

folding the lower portion upward;

securing the lower portion in a folded condition by attaching the spaced fasteners of the upper portion to the at least one fastener of the lower portion, with the longitudinal extent of the lower portion positioned across the chest of the infant;

folding one of the left and right side portions inward over the folded lower portion;

folding the other of the left and right side portions inward over the folded one of the left and right side portions; and attaching the fasteners of the left and right side portions to maintain the left and right side portions in a folded condition.

2. The method according to claim 1, wherein the upper portion defines a body portion configured to position a body of the infant and a head portion configured to position a head of an infant, wherein the body and head portions are continuous and the spaced fasteners are positioned on the body portion.

3. The method according to claim 2, wherein the body and head portions are padded.

4. The method according to claim 1, wherein the main body is kite-shaped and the head portion extends from the upper portion away from the lower portion.

5. The method according to claim 1, wherein the fasteners positioned on the left and right side portions include spaced first and second fasteners positioned on a front of the left side portion and spaced first and second fasteners positioned on a back of the right side portion.

6. The method according to claim 1, wherein the fasteners positioned on the left and right side portions include spaced first and second fasteners positioned on a front of the right side portion and spaced first and second fasteners positioned on a back of the left side portion.

7. The method according to claim 1, wherein the at least one fastener positioned on the back of the lower portion is an elongate loop fastener, and wherein each of the spaced fasteners positioned on the front of the upper portion are hook fasteners.

8. The method according to claim 1, wherein each of the spaced fasteners comprises a hook fastener and a loop fastener continuous with the hook fastener, wherein the hook fastener is configured to engaged with the loop fastener to maintain the spaced fastener in a closed condition between uses of the fastener.

* * * * *